US006309085B1

(12) United States Patent
Katz et al.

(10) Patent No.: US 6,309,085 B1
(45) Date of Patent: Oct. 30, 2001

(54) LAMP SUPPORT FOR EMERGENCY LIGHT FIXTURE

(75) Inventors: Albert Alvin Katz; Richard Melbourne Haughton, both of Newport Beach, CA (US)

(73) Assignee: Best Lighting Products, Inc., Santa Ana, CA (US)

( * ) Notice: Subject to any disclaimer, the term of this patent is extended or adjusted under 35 U.S.C. 154(b) by 0 days.

(21) Appl. No.: 09/558,182

(22) Filed: Apr. 26, 2000

(51) Int. Cl.[7] ..... F21V 17/18

(52) U.S. Cl. ..... 362/234; 362/147; 362/404; 362/427; 362/287; 248/222.11; 248/222.12; 248/222.13; 248/224.51

(58) Field of Search ..... 248/222.12, 222.11, 248/222.13, 224.51; 362/147, 404, 427, 287

(56) References Cited

U.S. PATENT DOCUMENTS 4,701,833 * 10/1987 Bornhost ..... 362/299
4,727,460 * 2/1988 Payne ..... 362/269
5,526,251 * 6/1996 Andre et al. ..... 362/396
5,735,498 * 4/1998 Jue et al. ..... 248/222.12
5,797,673 * 8/1998 Logan et al. ..... 362/234
6,142,648 * 11/2000 Logan et al. ..... 362/234

* cited by examiner

*Primary Examiner*—Anita King
*Assistant Examiner*—Steven M Marsh
(74) *Attorney, Agent, or Firm*—Price and Gess

(57) ABSTRACT

A lamp support comprises a plurality of attachment ends affixed to a bottom surface of a base member to attach the base member of the lamp support to a stationary object, preferably, an emergency exit sign. A pair of stems, equipped with a pair of engaging members at one end, extend from an upper surface of the base members. The engaging members face each other at one end. The engaging members include a plurality of flexible teeth that interface with a plurality of rotational faces located in a pair of rotational apertures located in a housing. The housing is attached to the pair of stems by the engaging member, enabling the housing to rotate 360 degrees on an axis created by the stems.

17 Claims, 2 Drawing Sheets

LAMP SUPPORT FOR EMERGENCY LIGHT FIXTURE

BACKGROUND OF THE INVENTION

1. Field of Invention

This invention relates to a lamp support, and more specifically, a lamp support for an emergency light fixture.

2. Description of Related Art

A number of different lamp supports for an emergency light have been developed. For example, U.S. Pat. No. 5,461,550 describes a canopy mounting device for an exit sign. In the exit sign, a canopy bracket has a pair of resilient spring fingers that are inserted through a central circular opening of a mounting plate mounted to a standard electrical box located in a wall or ceiling. The spring fingers temporarily secure the canopy bracket to the mounting plate, allowing an installer to align and secure screws to the mounting plate, and thereby, facilitating installation. The wires from the electrical box are extended through the mounting plate and the canopy prior to securing the canopy to the mounting plate. Once secured, the installer fits a hub portion of the canopy bracket telescopically within an opening with the exit sign housing. Spring capture barb members of the hub engage the housing to fixedly secure the exit sign to the wall or ceiling.

U.S. Pat. No. 4,124,880 discusses a rotating signal light for emergency vehicles in which a plastic lamp holder is mounted on a vertically disposed rotatable shaft. The lamp holder has a symmetrical notched configuration allowing two of such holders to be mated, one inverted and rotated 90 degrees relative to the other, so that the holder assembly may mount four lamps.

U.S. Pat. No. 4,435,743 discloses a lighted exit sign comprising a light transmitting plate having a viewing side and upper and lower edges onto which light can be projected for transmission into the plate for viewing from the viewing side. Upper and lower printed circuit boards are supported close to the upper and lower edges of the plate. A plurality of small incandescent light bulbs, secured to the upper and lower circuit boards, producing this light into the plate for viewing.

U.S. Pat. No. 5,797,673 shows an emergency lighting unit/exit sign combination that provides one or more emergency lamps mountable at different locations on the periphery of the fixture housing. The lamps are mounted by lamp holders mounted with swiveling concentric spherical structural elements that allow limited movement.

Many different lamp supports for an emergency light have been developed but these inventions do not solve the problem of providing adequate positioning of an ambient and/or directed light source in an emergency situation. The present invention overcomes these drawbacks.

SUMMARY OF THE INVENTION

The present invention provides a lamp support for an emergency light fixture that has superior positioning capability for an ambient and/or directed light source. The lamp support comprises a plurality of attachment ends affixed to a bottom surface of a base member to attach the base member. The base member attaches to a stationary object, preferably, an emergency exit sign. A pair of stems, equipped with a pair of engaging members, extend from an upper surface of the base member to face each other. The engaging members each have a plurality of flexible teeth that interface with a plurality of rotational faces located in a pair of rotational apertures embodied in a housing which is rotatably attached to the pair of stems, enabling the housing to rotate 360 degrees on an axis created by the pair of stems.

BRIEF DESCRIPTION OF THE DRAWINGS

The exact nature of this invention as well as its objects and advantages will be readily appreciated as it becomes better understood upon consideration of the following detailed description of a preferred embodiment of the invention in conjunction with the accompanying drawings in which like reference numerals designate like parts throughout the figures thereon and wherein.

DETAILED DESCRIPTION OF THE PREFERRED EMBODIMENTS

Figure 1:
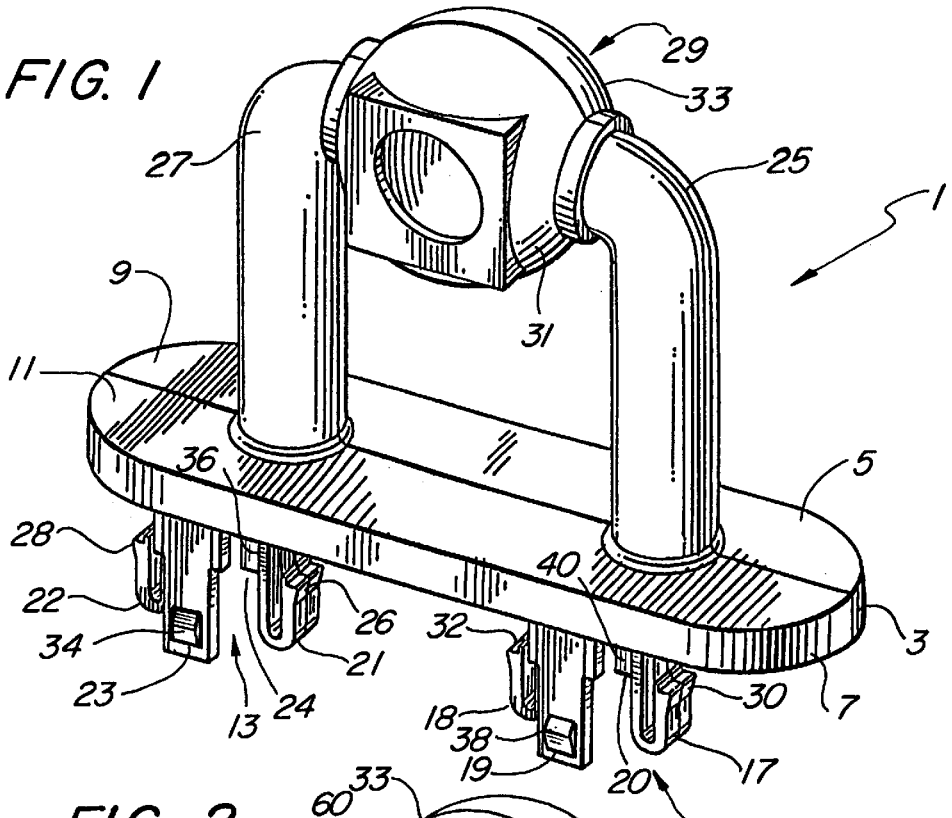
FIG. 1 is perspective view of the lamp support of the present invention.

Referring to FIG. 1, a preferred embodiment of a lamp support 1 according to the invention is illustrated. The lamp support 1 has a base member 3 with an upper surface 5 and a lower surface 7. A first attachment end 13 and a second attachment end 15 is affixed to the lower surface 7 of the base member 3. A first stem 25 and a second stem 27 is attached to the upper surface 5 of the base member 3. A housing 29 is rotatably connected to the first stem 25 and the second stem 27. The housing 29 provides support for a light structure of the type well known in the art.

The lamp support 1 is preferably constructed from a plastic material, such as polycarbonate/ABS, allowing the lamp support 1 to be molded. Use of molding to manufacture the lamp support reduces the number of parts that must be formed and assembled to produce the lamp support 1.

The base member 3 has a length ranging from six to thirty centimeters, a width ranging from one-half to five centimeters and a height ranging from two to ten centimeters. The base member 3 may be a single unit. However, in the preferred embodiment, the base member 3 has a first half 9 and a second half 11. This particular structure of the base member 3 eases the manufacturing process, i.e., molding, and expedites the assembly process. It is contemplated that the first half 9 and second half 11 may be connected with peg members (not shown) emanating from the first half 9 and being received by a receiving aperture located in the corresponding second half 11. The peg members and their receiving apertures may be located one to five centimeters apart from one another in order to facilitate a firm connection between the first half 9 and the second half 11. To further ensure a proper attachment between the first half 9 and the second half 11 of the base member 3, an epoxy or other similar fastening substance may be used to affix the two halves together.

The first attachment end 13 and the second attachment end 15 are affixed to the lower surface 7 of the base member 3. In the preferred embodiment, the first attachment end 13 comprises a first spring finger 21, a second spring finger 22, a first snap connector 23 and a second snap connector 24. The second attachment end 15 comprises a first spring finger 17, a second spring finger 18, a first snap connector 19 and a second snap connector 20. The first spring finger 21 of the first attachment end 13 has a tab end 26 that provides a biasing action. The second spring finger 22 of the first attachment end 13 has a tab end 28 that also provides a biasing action. The first spring finger 17 of the second attachment end 15 has a tab end 30 that provides a biasing action. The second spring finger 18 of the second attachment end 15 has a tab end 32 that also provides a biasing action. The biasing action facilitates a snap-fit engagement of the each spring finger 17, 18, 21 and 22 when the first attachment end 13 and the second attachment end 15 are inserted in an opening of a stationary object, such as, an emergency exit sign. Each spring finger 17, 18, 21 and 22 is dimensionally sized and placed to resiliently attach to an interior of an opening in a stationary object.

Figure 3:
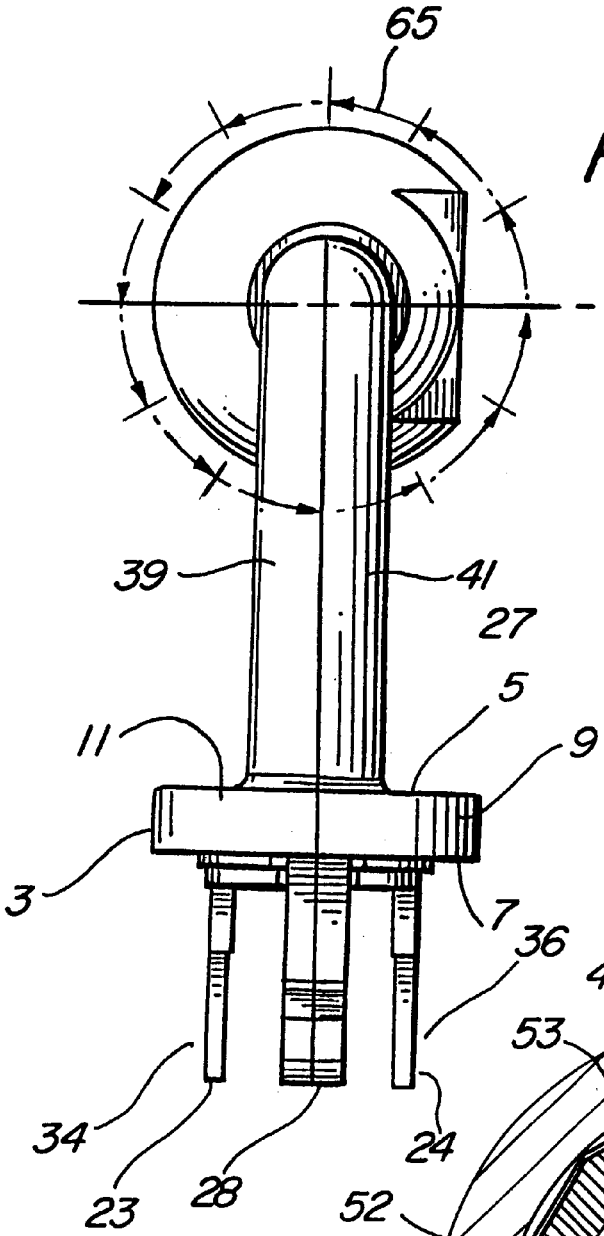
FIG. 3 is a left side elevational view of the lamp support of FIG. 1.

The first snap connector 23 of the first attachment end 13, the second snap connector 24 of the first attachment end 13, the first snap connector 19 of the second attachment end 15 and the second snap connector 20 of the second attachment end 15 insure proper positioning of the lamp support 1 when connecting the lamp support 1 to the emergency exit sign and provide a snap-fit engagement implemented by the spring fingers 17, 18, 21, 22 and the snap connectors 19, 20, 23, 24. The first snap connector 23 of the first attachment end 13 has a tab end 34. The second snap connector 24 of the first attachment end 13 has a tab end 36 (FIG. 3). The first snap connector 19 of the second attachment end 15 has a tab end 38. The second snap connector 20 of the second attachment end 15 has a tab end 40 (not shown). Tab ends 34, 36, 38 and 40 of their respective snap connectors provide a biasing action that facilitate a snap-fit engagement of each snap connector 19, 20, 23 and 24 when the first attachment end 13 and the second attachment end 15 are inserted in the opening of the emergency exit sign. Each of the snap connectors 19, 20, 23 and 24 are dimensionally sized and placed to resiliently attach to the interior of the opening in the emergency exit sign, capable of sustaining the weight of the lamp support, and ensure that the lamp support 1 is securely fastened to the emergency exit sign.

It is contemplated that prior to final installation of the lamp support 1 to the emergency exit sign, electrical wires, emanating from the emergency exit sign, may be inserted into a pair of openings in the base member 3, located at the foot of the first stem 25 and the second stem 27, respectively, and fed through the first stem 25 and/or the second stem 27, to connect to an electrical wire for a lighting structure affixed to the housing 29.

Figure 2:
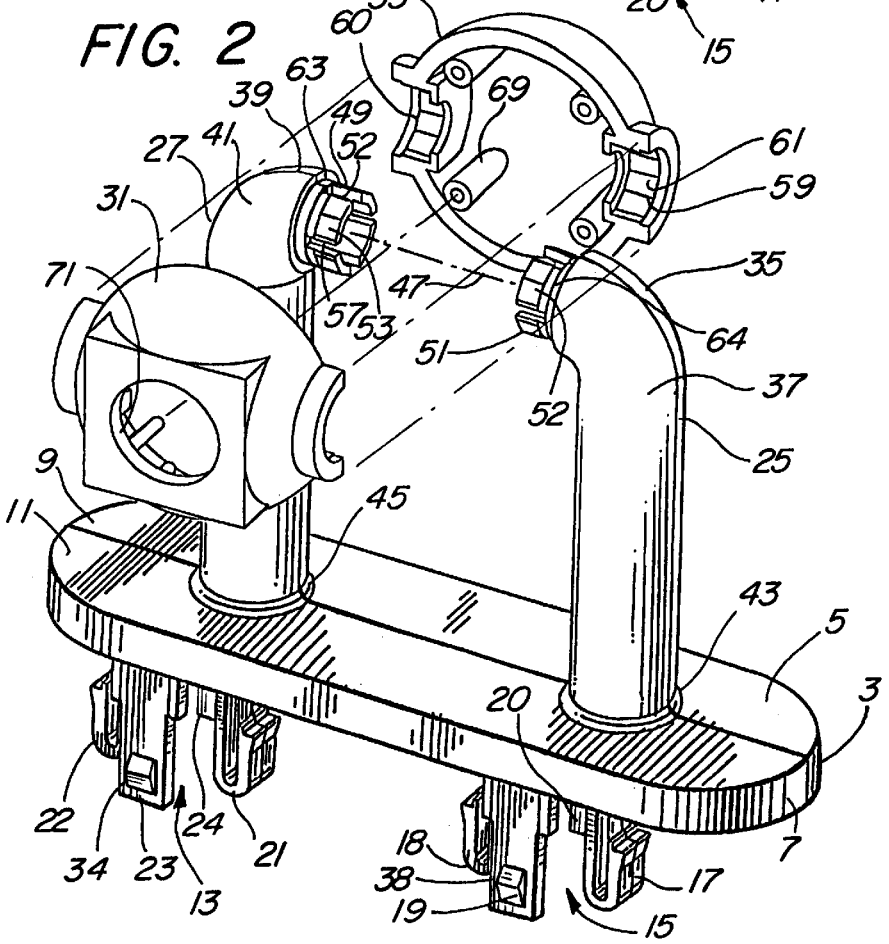
FIG. 2 is an exploded view of the lamp support of FIG. 1.

The first stem 25 and the second stem 27 extend in an upward direction from the upper surface of the base member 5. The first stem 25 and the second stem 27 have a length ranging from two to ten centimeters, a width ranging from one-half to five centimeters and a height ranging from one-half to five centimeters. As more clearly shown in FIG. 2, the preferred embodiment comprises first stem 25 having a first half 35 and a second half 37. A first attachment end 51 is located at their termination. The second stem 27 has a first half and a second half 41. A second attachment end 49 is located at their termination. The first stem 25 and the second stem 27 are preferably coupled with the base member 3 by a first weld 43 and a second weld 45, respectively. Alternatively, the first stem 25, second stem 27, and the base member 3 may be one unit.

The structure of the first stem 25 and the second stem 27 in two parts facilitate the manufacturing process, i.e., molding and expedites the assembly process. The first half of the first stem 35 and the first half of the second stem 39, may use ridges (not shown) to properly align with the second half of the first stem 37 and the second half of the second stem 41.

It is contemplated that the first half 35 and second half 37 of the first stem 25, and the first half 39 and second half 41 of the second stem 27, may be connected with peg members (not shown) emanating from the first half 35 of the first stem 25 and the first half 39 of the second stem 27 being received by a receiving aperture located in the second half 37 of the first stem 27 and the second half 41 of the second stem 27. The peg members and their receiving apertures may be located one to five centimeters apart from one another in order to facilitate a firm connection between the stem halves. To further ensure attachment between the stem halves, an epoxy or similar attachment substance may be implemented. The first and second halves of the first stem 35 and the first half and second halves of the second stem 39 may be connected by a peg (now shown), located on the first half 35 of the first stem 25 and the first half 33 of the second stem 27, and a receiving orifice that implements a locking prong (not shown), located on the second half 37 of the first stem 25 and the second half 41 of the second stem 22.

The first stem 25 and the second stem 27, extend in an upward direction from the upper surface of the base member 5 and turn approximately ninety degrees before ending in a first attachment end 51 at the first stem 25 and end 49 at second stem 27. The two attachment ends 49 and 51 lie on the same axis and face each other.

In the preferred embodiment, the first attachment end 51 and the second attachment end 49 are cylindrical in shape and have four separate engaging members 52. Each engaging member 52 has a first sliding surface 53 and a second sliding surface 55. The engaging members 52 are separate by a gap 57 that ensures adequate flexibility when the engaging members 52 are under pressure.

Figure 4:
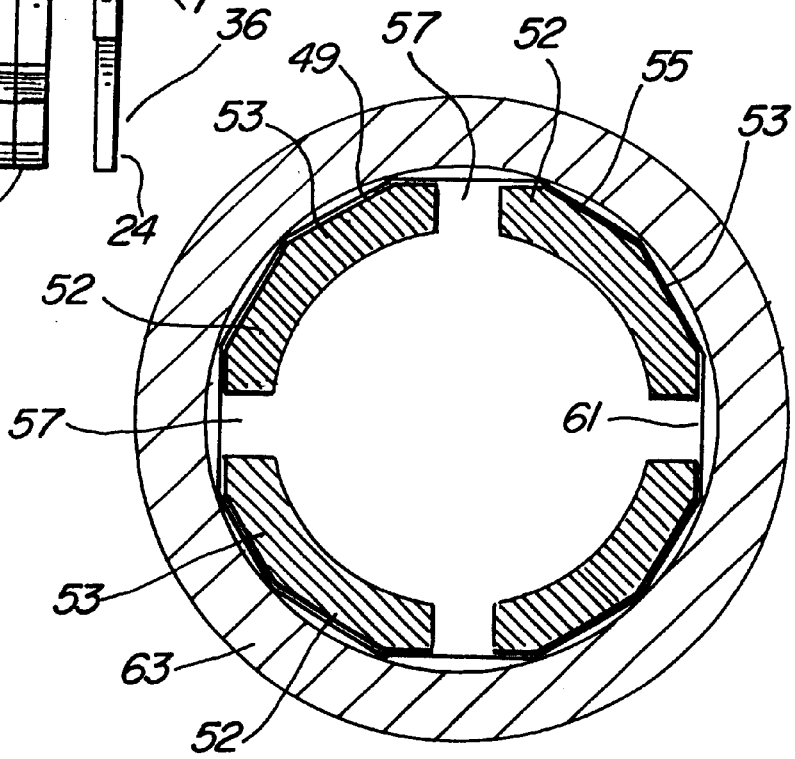
FIG. 4 is a cross-sectional view of the light housing showing the rotational surfaces in the engaging members and the light housing.

The engaging members 52 are designed to interface with a pair of apertures 59 in the housing 29. In the preferred embodiment, a first rotational aperture 59 and a second rotational aperture each have twelve sliding surfaces 61 that are adapted to accommodate the sliding surfaces 53, 55 of the engaging members 52 (FIG. 4). The numerous sliding surfaces 61 in the housing 29 permit the housing 29 to be positioned in small increments. A first stem face 64 and a second stem face 63 assist in guiding rotation of the housing 29 on the attachment ends 49, 51.

The housing 29 comprises a first half 31 and a second half 33. The first half 31 and the second half 33 have a length ranging from two to six centimeters, a width ranging from one to six centimeters and a height ranging from two to six centimeters. In the preferred embodiment, the first half 31 and the second half 33 of the housing are connected to the first stem 25 and the second stem 27. The first and second attachment ends 49, 51 fit into and are rotationally held by the first and second rotational apertures 59 and 60, in housing 29 along a rotational axis 47. The first stem 25 and the second stem 27 create the rotational axis 47 on which the housing 29 may rotate. The rotational axis 47 lies along the symmetrical center of the first and second stem. It is contemplated that the first stem 25 and the second stem 27 will be constructed from a plastic material, such as, polycarbonate/ABS, engineered to support the weight of the housing 29 and the lamp structure that may be attached to it.

Making the structure of the housing 29, in two parts, the first half 31 and the second half 33, eases the manufacturing process, i.e., molding, and expedites the assembly process. The first half 31 may use ridges (not shown) to properly align with the second half 33. It is contemplated that the second half 33 may be connected by a plurality of peg members 67 emanating from the first half 31 and engaging a plurality of receiving apertures 69 in the second half 33. To further ensure a permanent attachment between the first half 31 and the second half 33, an epoxy or other similar attachment substance may be used. The first half 31 and the second half 33 may also, alternatively, be connected by a peg, located on the first half 31 and a receiving orifice that implements a locking prong, located on the second half 33.

The first half 31 of the housing 29 is equipped with an opening 71 designed to accommodate a light structure. In the preferred embodiment, the opening 71 is circular. However, the opening may also be any other conventional geometric shape, such as a square, to facilitate attachment of a light structure as well known in the industry.

FIG. 3 is a left side elevation of the light housing 29 showing its ability to rotate three hundred and sixty degrees, as indicated by the directional arrow 65, around a rotational axis 47 created by the first stem 25 and the second stem 27. This ability of the housing 29 to rotate enables a user to position a light source in any of a variety of front and back positions to directly illuminate a path to an exit or the exit itself during an emergency situation.

FIG. 4 is a cross-sectional view of the engaging members 52 located on the first stem 25 and the second stem 27. Such engaging member 52 has a first sliding surface 53 and a second sliding surface 55, in a different plane but lying along the same circumference. The engaging members are constructed of a plastic material, such as a polycarbonate/ABS. Coupled with the gaps 57, a flexible structure is provided. Flexibility is required to permit rotation when the engaging members 52 are positioned in the first rotational aperture 59 and the second rotational aperture 60 of the housing 29. The gaps 57, located between the engaging members 52 provide ample space for the members 52 to flex in reaction to the force exerted upon the members 52 by the rotational surfaces 61 of the first rotational aperture 59 and the second rotational aperture 60 when the housing 29 is being rotated.

Having illustrated and described a preferred embodiment as well as variants of this invention, it will be obvious to those skilled in the art that further changes and modifications may become apparent. Such changes and modifications are to be considered within the scope and essence of this invention.

What is claimed is:

1. A lamp support for an emergency light fixture comprising:

a first stem;

a second stem; and a housing rotatably attached between the first stem and the second stem whereby the housing is capable of rotation 360 degrees about an axis between the first and second stem.

2. The lamp support of claim 1, further comprising a base member having an upper side and a lower side with the first stem and the second stem being attached to the upper side of the base member.

3. The lamp support of claim 1, further comprising a plurality of attachment ends affixed to the lower side of the base member.

4. The lamp support of claim 1 wherein the plurality of attachment ends comprise a spring finger and a snap connector to secure the mounting of the base member.

5. The lamp support of claim 1, wherein the first stem and the second stem include a plurality of engaging members.

6. The lamp support of claim 5, wherein each engaging member has a first and a second sliding surface.

7. The lamp support of claim 5 wherein the plurality of engaging members are separated by a gap.

8. The lamp support of claim 1, wherein the light comprises a first rotational aperture and a second rotational aperture within which the first and second stem insert.

9. The lamp support of claim 8 wherein the first rotational aperture and the second rotational aperture contain a plurality of rotational faces that control the sliding faces on the engaging members.

10. A lamp support for an emergency light fixture, comprising:

a housing adapted for supporting a light source; and a mounting structure rotatably connected to the housing to permit rotation of the housing about an axis determined by the mounting structure.

11. The lamp support of claim 10 wherein the housing includes an aperture that receives a part of the mounting structure and about which the housing rotates.

12. The lamp support of claim 11 wherein the housing further comprises a plurality of sliding surfaces located along a single circumference in the aperture of the housing.

13. The lamp support of claim 12 wherein the mounting structure comprises a plurality of spaced apart teeth, each having a sliding surface thereon located along a single circumference for engaging the sliding surfaces in the aperture of the housing.

14. The lamp support of claim 13 wherein each of said teeth has a plurality of sliding surfaces thereon, all the sliding surfaces located along a single circumference.

15. The lamp support of claim 14 wherein the mounting structure comprises a first and a second stem positioned to have an end of the first stem facing an end of the second stem while lying along the same symmetrical axis, each stem having the spaced apart teeth located at the facing ends.

16. The lamp support of claim 15 further comprising a base attached to the ends of the first and second stems that do not face each other for supporting the first and second stems.

17. The lamp support of claim 16 wherein the base includes attachment fingers adapted for attaching the base to an emergency light fixture.

* * * * *